United States Patent [19]

Gumbinner et al.

[11] Patent Number: 4,777,109

[45] Date of Patent: Oct. 11, 1988

[54] RF PLASMA TREATED PHOTOSENSITIVE LITHOGRAPHIC PRINTING PLATES

[76] Inventors: Robert Gumbinner; Gregory Halpern, both of Wilson Park Dr., Tarrytown, N.Y. 10591

[21] Appl. No.: 48,425

[22] Filed: May 11, 1987

[51] Int. Cl.[4] ..... G03C 1/94; G03C 1/52; G03C 1/68; G03C 1/74

[52] U.S. Cl. ..... 430/155; 430/157; 430/158; 430/165; 430/167; 430/276; 430/278; 430/302; 430/525; 430/526

[58] Field of Search ..... 430/276, 278, 302, 155, 430/157, 158, 165, 167, 264, 525, 526

[56] References Cited

U.S. PATENT DOCUMENTS

| | | | |
|---|---|---|---|
| 2,714,066 | 7/1955 | Jewett et al. | 430/175 |
| 2,946,683 | 7/1960 | Mellan et al. | 430/161 |
| 3,046,120 | 7/1962 | Schmidt et al. | 430/190 |
| 3,136,636 | 6/1964 | Dowdall et al. | 430/161 |
| 3,568,614 | 2/1986 | Eichen et al. | 428/450 |
| 3,591,575 | 7/1971 | Golda | 430/175 |
| 3,635,709 | 1/1972 | Kobayashi | 430/190 |
| 4,072,589 | 2/1978 | Golda et al. | 101/459 |
| 4,299,912 | 11/1981 | Shiba et al. | 430/302 |
| 4,396,450 | 8/1983 | Blenner et al. | 156/272.6 |
| 4,436,761 | 3/1984 | Hayashi et al. | 427/38 |
| 4,490,190 | 12/1984 | Speri | 148/16.6 |
| 4,500,564 | 2/1985 | Enomoto | 427/39 |
| 4,522,660 | 6/1985 | Suzuki et al. | 148/20.3 |
| 4,524,089 | 6/1985 | Haque et al. | 427/38 |
| 4,543,275 | 12/1985 | Akashi et al. | 427/250 |
| 4,603,056 | 7/1986 | Mackinnon et al. | 427/38 |
| 4,603,057 | 7/1986 | Ueno et al. | 427/40 |
| 4,618,398 | 10/1986 | Nawata et al. | 156/643 |
| 4,672,022 | 6/1987 | Reiss et al. | 430/276 |

FOREIGN PATENT DOCUMENTS

| | | | |
|---|---|---|---|
| 197810 | 10/1978 | Fed. Rep. of Germany | 430/276 |

*Primary Examiner*—Charles L. Bowers, Jr.

*Attorney, Agent, or Firm*—David H. Semmes; Warren E. Olsen

[57] ABSTRACT

A metal base lithographic printing plate cleaned and treated by RF plasma to render the non-exposed area hydrophilic, then coated with either a negative working or positive working photosensitive coating. The method is characterized by its elimination of the conventional alkaline etch with attendant hazard, pollution and toxicity problems.

11 Claims, No Drawings

RF PLASMA TREATED PHOTOSENSITIVE LITHOGRAPHIC PRINTING PLATES

BACKGROUND OF THE INVENTION

1. Field of the Invention

Lithographic printing plates of the type having a metal base sheet to which a photosensitive coating has been applied. Particularly, the treating of metal base sheets with low temperature RF plasma prior to application of the photosensitive coating. Traditionally, etching and degreasing solvents are employed to clean the metal base plate prior to application of the photosensitive coating.

SUMMARY OF THE INVENTION

A metal base lithographic printing plate of the type having a photosensitive coating. Particularly, a metal base lithographic printing plate which is cleaned and treated by RF plasma prior to pressure application of the photosensitive coating. The use of the RF plasma eliminates the necessity for the use of conventional alkaline etches and solvent degreasers with attendant fire hazard, air pollution and toxicity problems. The RF plasma treatment renders the surface hydrophilic prior to photosensitive coating.

DESCRIPTION OF THE PREFERRED EMBODIMENTS

In order to make a metal perform successfully as a lithographic plate, it is necessary that the non-image area of the metal plate be rendered hydrophilic, i.e., water receptive. Applicants render the metal plate hydrophilic without the use of chemicals.

In manufacturing conventionally presensitized lithographic metal plates, the first step is to clean the surface of the metal, e.g. aluminum. Some of the methods that have been used are solvent degreasing and etching with an alkaline solution, (such as 0.5% sodium hydroxide at 120° F. or a 10% solution of trisodium phosphate at 165° to 180° F.), graining with sand and/or pumice with brushes or marbles, and sand blasting.

These methods all have drawbacks. The use of solvents, besides potential fire hazard, air pollution and toxicity problems, does not render the metal surface as hydrophilic as desired and may leave traces of organic material which cannot be completely removed.

Cleaning of the metal lithographic plates by alkaline solvents requires careful control, for as the aluminum in the solution builds up, the degree of etching can change. After the alkaline cleaning, it is necessary to remove the smut that has been formed. An acid desmut solution may be employed. Such desmut solutions often contain chromic acid or concentrated nitric acid which are dangerous to handle, cause pollution problems and, in turn, if the conditions are not carefully controlled, themselves etch the metal and create a smut.

The cleaning of the metal lithographic plate with an abrasive can result in fine particles of the abrasive being embedded in the metal. Quite often, in order to remove these small particles of abrasive, after the graining process, the metal plate is subjected to an alkaline etch to remove the surface material, followed by the acid desmut solution. It is also necessary, of course, to provide for disposal of the used abrasive.

We have found that by treating the metal with a low temperature RF plasma, the surface of the metal becomes hydrophilic without the use of chemicals or other materials.

While low temperature plasma treatment is often used to clean glass and crystal surfaces, it has not been used for treating metals for lithographic plates. BLENNER et al., U.S. Pat. No. 4,396,450, disclose use of a low temperature plasma for bonding elastomers but the method calls for a treatment time greater than 30 minutes, while the present method requires less than three minutes. Longer times can, of course, be used but do not create any additional benefits. Low temperature plasma has been used, also, for chemical vapor deposition (CVD) and other methods to deposit various layers on metals as in HAYASHI et al 4,436,761 and AKASHI et al. 4,543,275.

Applicant herein sets forth examples of producing lithographic printing plates buy treating of the metal base plate with low temperature RF plasma and applying a photosensitive coating capable of being processed to form a lithographic printing plate to the plasma treated surface. The photosensitive coating may be applied by any number of techniques, for example whirling, reverse roll, knife coating and the like.

EXAMPLE 1

A sheet of aluminum was placed within the cylindrical quartz chamber of a low temperature plasma machine. The cylindrical quartz chamber was evacuated to $10^{-3}$ to $10^{-6}$ torr and the RF plasma activated. Suitable power conditions for the RF plasma may range from 500 kiloHertz to megaHertz, depending upon the size of the sheet. A small amount of air was then bled into the chamber to raise the pressure to about 1 torr, so that the blue plasma glow became red. After one minute, the plasma and vacuum were turned off. After the chamber was at atmospheric pressure, the aluminum sheet was removed.

The surface of the aluminum was then roughened by brushing with a slurry of equal parts of sand and pumice. The aluminum sheet was then rinsed with water, dried and again treated with the lower temperature RF plasma for one minute. A positive working photosensitive coating was applied using a knife coating of "Shipley's AZ 1350J" photoresist. Such photosensitive coatings typically consist of a solution of an ester of ortho naphthoquinone diazide sulfonic acid and hydroxy-containing organic compound, (such as a phenolic resin or pyragallol-acetone resin as disclosed in SCHMIDT et al. U.S. Pat. No. 3,046,120 and KOBAYASHI No. 3,635,709), and 0.2 to 4 parts of a Novolak resin, preferably with a melting point between 135° F. and 175° F. in an organic solvent. Various dyes are usually added, so that the exposed image is visible before and after developing.

After allowing the photosensitive coating to age on the aluminum plate for two weeks, the plate was exposed within a vacuum frame to ultraviolet light and carbon arc light for four minutes under a positive transparency. The exposed non-image area of the photosensitive coating decomposed, so that it was soluble in an alkaline developer. This developer, an aqueous solution containing 5% trisodium phosphate, 2% BW silicate (Philadelphia Quartz) and 0.1% sodium hydroxide removed the exposed photosensitive coating leaving a strong image in the unremoved portion of the coating. The plate was then washed, neutralized with a solution of 0.1% phosphoric acid and 2% gum arabic, then washed again and placed on an offset press. Thousands of clean, high-quality copies were obtained.

EXAMPLE 2

The same procedures as in Example 1 were followed, except that instead of roughening the surface of the aluminum plate by brushing with a slurry of sand and pumice, the surface was roughened by electrolytic alternate current etching with dilute hydrochloric acid, somewhat as disclosed in GOLDA et al. U.S. Pat. No. 4,072,589.

After the electrolytic etching, the aluminum plate may be further treated with RF plasma before applying the positive working photosensitive coating. Alternatively, the aluminum sheet may be anodized with sulfuric acid before the plasma treatment. Besides sulfuric acid anodizing, other anodizing treatments which have been used for lithographic plates may be applied, for example anodizing with phosphoric acid or phosphoric and sulfuric acid mixtures.

EXAMPLE 3

An aluminum plate was plasma cleaned as in Example 1. It was then immersed in a 0.5% ferric chloride for thirty seconds and then thoroughly rinsed. The sheet was again given the plasma treatment.

A positive photosensitive coating was applied to the aluminum plate with a knife coater. The plate was dried and aged for two weeks. After exposure under ultraviolet light, the exposed portion of the coating was removed with a mildly alkaline developer leaving a strong image in the unexposed portion.

EXAMPLE 4

A sheet of aluminum was placed within the quartz chamber of a low temperature plasma machine. The cylinder was evacuated to $10^{-3}$ to $10^{-6}$ torr and the RF plasma activated. Suitable RF power conditions may range from 500 kiloHertz to 10 megaHertz, depending upon the size of the sheet. A small amount of air was bled into the chamber to raise the pressure to about 1 torr, so that the blue plasma glow became red. After one minute the plasma and vacuum were turned off. After the chamber was at atmospheric pressure, the aluminum plate was removed.

The aluminum plate was then put in an anodizing bath consisting of a solution of sulfuric acid at a concentration of approximately 15% at 80° F. The aluminum was connected as the anode, a lead sheet being the cathode. A direct current was applied by raising the voltage over ten seconds from zero to 12 volts. The aluminum sheet was anodized for an additional one minute. The aluminum plate was removed from the bath, disconnected from power and rinsed with water.

The plate was then immersed in a 3% by volume solution of sodium silicate in water (as manufactured by Philadelphia Quartz "Silicate E") at 180° F. for three minutes. It was again rinsed and dried as disclosed in JEWETT et al. U.S. Pat. No. 2,714,066. The aluminum plate was then coated with a 2% solution in water of the condensation product of the diazo of para amino diphenyl amine and formaldehyde by dipping the plate in the solution and then passing the plate through a set of squeeze rollers. It was then dried under infrared lamps. The presensitized aluminum plate was then wrapped in light-proof paper.

A week later the plate was unwrapped and an image "burned-on" the plate by exposing it within a vacuum frame to ultra violet light under a negative which included a half tone, 10% screen and line copy (carbon arc light) for three minutes. A few ounces of lithographic one-step developer were poured on the exposed plate and the image was developed with a cellulose sponge. The image was strong, ink receptive and background clean. The plate was then mounted on an offset press (A&M 1250 Multilith) and thousands of good quality copies were printed.

EXAMPLE 5

The same procedure as in Example 4 was followed except that after the plate was rinsed and anodized, it was dried and treated with the low temperature RF plasma for a minute before immersion within the silicate solution.

After twenty thousand copies, the printed sheets from this example showed less change than those run off from the plate in Example 1.

EXAMPLE 6

The same procedure as in Example 5 was followed except that after the aluminum sheet had been immersed in the sodium silicate solution and rinsed, it was dried and given the RF plasma treatment for one minute before the plate was coated with the formaldehydediazo condensation product.

After exposure and development with a one-step developer, a small amount of the lacquer stained part of the non-image area. The bond of the lacquer to the plate was very strong.

Another plate treated by the process of Example 3 was exposed to ultraviolet light through a negative and developed using the two-step process. That is, the non-exposed area was removed with a desensitizing solution, which was composed of 5% sodium laurel sulfate, 5% citric acid, 0.1% oxalic acid and 5% gum arabic in water. The exposed image was then developed using Minnesota Mining and Manufacturing Company's "Type R" lacquer, which is an emulsion of solid epoxy resins dissolved in ethyl butyl ketone and cellulose gum in water.

The plate, so desensitized and developed, had a sharp dense image and a clean background. A press run of many thousands of copies was made from it.

In the above examples, the condensation product of the diazo of para amino diphenyl amine with formaldehyde was used as the light sensitive coating. Any of the other negative working coatings (the image becomes insoluble on exposure to light) emphasized in the lithographic industry may be used. Some of these negative coating working solutions include:

(a) A coating having albumin or casein sensitized with a dichromate, if the plate is to be exposed and developed within a few days.

(b) An organic soluble derivative of the condensation product of the diazo of para amino diphenyl amine with formaldehyde, such as is formed by reacting it with a hydroxy benzo-phenone such as BASF Uvenol MS40 and disclosed in GOLDA U.S. Pat. No. 3,591,575. In this case, the coating solution can also contain from resins 2 to 10 parts to 1 part of the diazo in a solvent composed of a mixture of methyl cellulose, dimethyl formamide and ethylene chloride.

(c) A photopolymer such as Eastman Kodak's "KPR"—a photosensitive polyvinyl cinnamate, or an ethylene unsaturated oligimer, sensitized with a compound such as Michler's "Ketone" plus an initiator.

In these aforelisted coating solutions, an appropriate developing solution for the coating is used to remove the non-photo polymerized coating from the non-image area.

Besides the interlayer formed by the reaction of the aluminum with sodium silicate, those interlayers which have been described in the literature can be used. Among these are potassium zirconium hexafluoride as disclosed in MELLAN et al. U.S. Pat. No. 2,946,683, and organic polyacids as disclosed in DOWDALL et al. U.S. Pat. No. 3,136,636, e.g. polyacrylic acid, polyacidic cellulose polymer and polyvinyl phosphonic acid.

In addition to aluminum, other metal plates which can be rendered hydrophilic may be used. These plates are usually combination plates of zinc and other metals which have been electroplated with one or more metals, ending up with a top surface of chromium.

In addition to air, other gasses, such as nitrogen, oxygen, argon and the like, may be used to clean and plasma etch the surface.

We claim:

1. A lithographic printing plate comprising:
(a) an aluminum base sheet treated by low temperature RF plasma powered for approximately one minute in the range 500 kiloHertz to 10 megaHertz, while said aluminum sheet is supported within a vacuum, said sheet being then dried and again treated with low temperature RF plasma for approximately one minute; and
(b) a photosensitive coating capable of being processed to form a lithographic printing plate applied to the plasma treated surface of said metal base sheet.

2. A lithographic printing plate as in claim 1, wherein said photosensitive coating is a positive working coating comprising a compound made from diazo oxide.

3. A lithographic printing plate as in claim 1 wherein the coating is negative working photosensitive coating.

4. A lithographic printing plate as in claim 3, wherein the photosensitive coating is a condensation product of para amino diphenyl amine with formaldehyde and derivatives.

5. A lithographic printing plate as in claim 3, in which the photosensitive coating is a photopolymer.

6. A lithographic printing plate as in claim 4, wherein said condensation product is formed in layers upon the plasma treated surface.

7. A lithographic printing plate as in claim 1, wherein the metal base sheet is coated with a metal selected from the group consisting of aluminum, zinc or chromium.

8. A lithographic printing plate comprising:
(a) an aluminum base metal sheet treated by low temperature RF plasma powered for approximately one minute in the range 500 kiloHertz to 10 megaHertz, while said aluminum sheet is supported within a vacuum, said sheet being then dried and again treated with low temperature RF plasma for approximately one minute, said sheet then being roughened by electrolytic alternate current and etched with dilute hydrochloric acid, and
(b) a photosensitive coating capable of being processed to form a lithographic printing plate applied to the plasma treated surface of said base metal sheet.

9. A lithographic printing plate comprising:
(a) an aluminum metal base sheet treated by low temperature RF plasma powered for approximately one minute in the range 500 kiloHertz to 10 megaHertz, while said aluminum sheet is supported within a vacuum, said sheet then being then dried and again treated with low temperature RF plasma for approximately one minute, said sheet then being anodized in a sulfuric acid solution, rinsed, then immersed in a solution of sodium silicate approximately 3% by volume, rinsed and dried prior to:
(b) photosensitive coating with a 2% solution in water of a condensation product of the diazo of para amino diphenyl amine and formaldehyde.

10. A lithographic printing plate as in claim 9, which has been further treated with low temperature RF plasma prior to immersion within the solution of sodium silicate.

11. A lithographic printing plate as in claim 10, which has been further treated with RF plasma after immersion in said sodium silicate solution.

* * * * *